US009214330B2

(12) United States Patent
Kawakami et al.

(10) Patent No.: US 9,214,330 B2
(45) Date of Patent: Dec. 15, 2015

(54) LIGHT SOURCE DEVICE AND FILAMENT

(71) Applicant: STANLEY ELECTRIC CO., LTD., Meguro-ku, Tokyo (JP)

(72) Inventors: Yasuyuki Kawakami, Chiba (JP); Takahiro Matsumoto, Yokohama (JP); Takao Saito, Tokyo (JP); Kei Emoto, Ibaraki (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/368,783

(22) PCT Filed: Dec. 20, 2012

(86) PCT No.: PCT/JP2012/083088
§ 371 (c)(1),
(2) Date: Jun. 25, 2014

(87) PCT Pub. No.: WO2013/099759
PCT Pub. Date: Jul. 4, 2013

(65) Prior Publication Data

US 2014/0346944 A1 Nov. 27, 2014

(30) Foreign Application Priority Data

Dec. 26, 2011 (JP) ..... 2011-284068

(51) Int. Cl.
*H01J 5/16* (2006.01)
*H01J 61/40* (2006.01)
(Continued)

(52) U.S. Cl.
CPC .. *H01K 1/26* (2013.01); *H01K 1/04* (2013.01); *H01K 1/10* (2013.01); *H01K 3/02* (2013.01)

(58) Field of Classification Search
CPC ..... H01K 1/26; H01K 1/04; H01K 1/10; H01K 3/02
See application file for complete search history.

(56) References Cited

U.S. PATENT DOCUMENTS 3,973,155 A * 8/1976 Warren et al. ..... 313/578
4,361,598 A * 11/1982 Yoldas ..... 427/74
(Continued)

FOREIGN PATENT DOCUMENTS

JP 55072357 A 5/1980
JP 56145652 A 11/1981
(Continued)

OTHER PUBLICATIONS

F. Kusunoki et al., "Narrow-Band Thermal Radiation with Low Directivity by Resonant Modes inside Tungsten Microcavities", Japanese Journal of Applied Physics, vol. 43, No. 8A, 2004, pp. 5253-5258 (in English).
(Continued)

*Primary Examiner* — Donald Raleigh
(74) *Attorney, Agent, or Firm* — Holtz, Holtz, Goodman & Chick PC

(57) ABSTRACT

A light source device comprising a filament showing high electric power-to-visible light conversion efficiency is provided. The light source device of the present invention comprises a translucent gastight container, a filament disposed in the translucent gastight container, and a lead wire for supplying an electric current to the filament. The filament comprises a substrate formed from a metal material and a visible light-absorbing film covering the substrate. The visible light-absorbing film is transparent to lights of infrared region. The reflectance of the substrate for visible lights is thereby made low, and the reflectance of the substrate for infrared lights is thereby made high. Therefore, radiation of infrared lights is suppressed, and visible luminous efficiency can be enhanced.

17 Claims, 9 Drawing Sheets

(51) Int. Cl.

| | |
|---|---|
| ***H01K 1/26*** | (2006.01) |
| ***H01K 1/30*** | (2006.01) |
| ***H01K 1/10*** | (2006.01) |
| ***H01K 3/02*** | (2006.01) |
| ***H01K 1/04*** | (2006.01) |

(56) References Cited

U.S. PATENT DOCUMENTS

| | | | | |
|---|---|---|---|---|
| 5,955,839 | A | 9/1999 | Jaffe et al. | |
| 2004/0232837 | A1 * | 11/2004 | King | 313/578 |
| 2006/0076868 | A1 | 4/2006 | Pullini et al. | |
| 2006/0103286 | A1 * | 5/2006 | Lambertini et al. | 313/311 |
| 2007/0228951 | A1 | 10/2007 | Sommerer et al. | |
| 2010/0327731 | A1 * | 12/2010 | Aurongzeb et al. | 313/316 |
| 2012/0074441 | A1 * | 3/2012 | Seo et al. | 257/91 |
| 2012/0113505 | A1 * | 5/2012 | Chen et al. | 359/359 |
| 2012/0286643 | A1 * | 11/2012 | Ozin | 313/112 |

FOREIGN PATENT DOCUMENTS

| | | | |
|---|---|---|---|
| JP | 59058752 | A | 4/1984 |
| JP | 60253146 | A | 12/1985 |
| JP | 62010854 | A | 1/1987 |
| JP | 62501109 | A | 4/1987 |
| JP | 06002167 | A | 1/1994 |
| JP | 06005263 | A | 1/1994 |
| JP | 10289689 | A | 10/1998 |
| JP | 2000123795 | A | 4/2000 |
| JP | 2000215858 | A | 8/2000 |
| JP | 2000260398 | A | 9/2000 |
| JP | 2001519079 | A | 10/2001 |
| JP | 2002222638 | A | 8/2002 |
| JP | 2003168399 | A | 6/2003 |
| JP | 2006205332 | A | 8/2006 |
| JP | 2006520074 | A | 8/2006 |
| JP | 2010272435 | A | 12/2010 |
| JP | 2011124206 | A | 6/2011 |
| JP | 2011222211 | A | 11/2011 |
| WO | 8602775 | A1 | 5/1986 |
| WO | 9843281 | A1 | 10/1998 |
| WO | WO 2011057410 | A1 * | 5/2011 ..... H01K 9/00 |

OTHER PUBLICATIONS

International Search Report (ISR) dated Feb. 5, 2013 issued in International Application No. PCT/JP2012/083088.

English machine translation of JP 2011-124206.

International Preliminary Report on Patentability (IPRP) dated Jul. 10, 2014 issued in International Application No. PCT/JP2012/083088.

U.S. Appl. No. 14/368,795, filed Jun. 25, 2014, First Named Inventor: Takahiro Matsumoto, Title: "Light Source Device and Filament".

* cited by examiner

--Ta rough surface--

--Ta mirror surface--

| Radiation controlling structure | R (550nm) | R (1um) | Cut - off | Luminous efficiency η |
|---|---|---|---|---|
| (SiC/MgO)/Ta | 0.025 | 0.996 | 651 nm | 103.2 lm/W |
| (SiC/$ZrO_2$)/Ta | 0.027 | 0.990 | 705 nm | 75.4 lm/W |
| (SiC/$Y_2O_3$)/Ta | 0.01 | 0.997 | 653 nm | 101.6 lm/W |
| (SiC/$HfO_2$)/Ta | 0.025 | 0.997 | 678 nm | 90.0 lm/W |
| (SiC/$Lu_2O_3$)/Ta | 0.025 | 0.996 | 718 nm | 80.6 lm/W |
| (SiC/$Yb_2O_3$)/Ta | 0.021 | 0.996 | 712 nm | 79.8 lm/W |
| (SiC/$SiO_2$)/Ta | 0.025 | 0.998 | 644 nm | 113.0 lm/W |
| ($HfO_2$/$SiO_2$)/Ta | 0.11 | 0.998 | 744 nm | 81.5 lm/W |
| ($Lu_2O_3$/$SiO_2$)/Ta | 0.08 | 0.999 | 732 nm | 94.0 lm/W |

Fig.7

LIGHT SOURCE DEVICE AND FILAMENT

TECHNICAL FIELD

The present invention relates to a filament for light sources showing improved energy utilization efficiency, and it also relates to, in particular, a light source device, especially an incandescent light bulb and a near infrared or thermoelectronic emission source, utilizing such a filament.

BACKGROUND ART

There are widely used incandescent light bulbs which produce light with a filament such as tungsten filament heated by flowing an electric current through it. Incandescent light bulbs show a radiation spectrum close to that of sunlight providing superior color rendering properties, and show high electric power-to-light conversion efficiency of 80% or higher. However, 90% or more of the components of the light radiated by incandescent light bulbs consists of infrared radiation components as shown in FIG. 1 (in the case of 3000K in FIG. 1). Therefore, the electric power-to-visible light conversion efficiency of incandescent light bulbs is as low as about 15 lm/W. In contrast, the electric power-to-visible light conversion efficiency of fluorescent lamps is about 90 lm/W, which is higher than that of incandescent light bulbs. Therefore, although incandescent light bulbs show superior color rendering properties, they impose larger environmental loads compared with fluorescent lamps.

Various proposals have been made so far as attempts for realizing higher efficiency, higher luminance and longer lifetime of incandescent light bulbs. For example, Patent documents 1 and 2 propose a configuration for realizing a higher filament temperature, in which an inert gas or halogen gas is enclosed in the inside of an electric bulb so that the evaporated filament material is halogenated and returned to the filament (halogen cycle) to obtain higher filament temperature. Such a lamp is generally called halogen lamp, and such a configuration provides the effects of increasing electric power-to-visible light conversion efficiency and prolonging filament lifetime. In this configuration, type of the gas to be enclosed and control of the pressure thereof are important for obtaining increased efficiency and prolonged filament lifetime.

Patent documents 3 to 5 disclose a configuration in which an infrared light reflection coating is applied on the surface of electric bulb glass to reflect infrared lights emitted from the filament and return them to the filament, so that the returned lights are absorbed by the filament. The filament is re-heated with the infrared lights absorbed by the filament to attain higher efficiency.

Patent documents 6 to 9 propose a configuration that a microstructure is produced on the filament itself, and infrared radiation is suppressed by the physical effects of the microstructure to increase the rate of visible light radiation.

PRIOR ART REFERENCES

Patent documents

Patent document 1: Japanese Patent Unexamined Publication (Kokai) No. 60-253146
Patent document 2: Japanese Patent Unexamined Publication (Kokai) No. 62-10854
Patent document 3: Japanese Patent Unexamined Publication (Kokai) No. 59-58752
Patent document 4: Japanese Patent Unexamined Publication (Kohyo) No. 62-501109

Patent document 5: Japanese Patent Unexamined Publication (Kokai) No. 2000-123795
Patent document 6: Japanese Patent Unexamined Publication (Kohyo) No. 2001-519079
Patent document 7: Japanese Patent Unexamined Publication (Kokai) No. 6-5263
Patent document 8: Japanese Patent Unexamined Publication (Kokai) No. 6-2167
Patent document 9: Japanese Patent Unexamined Publication (Kokai) No. 2006-205332

Non-Patent Document

Non-patent document 1: F. Kusunoki et al., Jpn. J. Appl. Phys., 43, 8A, 5253 (2004)

SUMMARY OF THE INVENTION

Object to be Achieved by the Invention

Although the effect for prolonging the lifetime is realizable with the technique of using the halogen cycle such as those disclosed in Patent documents 1 and 2, it is difficult to markedly improve the conversion efficiency with such a technique, and the efficiency currently obtainable thereby is about 20 lm/W.

Further, the technique of reflecting infrared lights with an infrared light reflection coating to cause the reabsorption by the filament such as those described in Patent documents 3 to 5 cannot provide efficient reabsorption of infrared lights by the filament, since the filament has a high reflectance for infrared lights as high as 70%. Furthermore, the infrared lights reflected by the infrared light reflection coating are absorbed by the parts other than the filament, for example, the part for holding the filament, base, and so forth, and are not fully used for heating the filament. For these reasons, it is difficult to significantly improve the conversion efficiency with this technique. The efficiency currently obtainable thereby is about 20 lm/W.

Concerning the technique of suppressing infrared radiation lights with a microstructure such as those described in Patent documents 6 to 9, there have been reported the effects of enhancing and suppressing lights of only an extremely small part of the wavelength region of the infrared radiation spectrum as reported in Non-patent document 1, but it is extremely difficult to suppress infrared radiation lights over the wide total range of the infrared radiation spectrum. This is because the infrared radiation lights have a property that infrared light of a certain wavelength is suppressed, those of the other wavelengths are enhanced. Therefore, it is considered that it is difficult to attain marked improvement in the efficiency with this technique. Furthermore, the production of the microstructure requires use of a highly advanced microprocessing technique such as the electron beam lithography, and therefore light sources produced by utilizing it becomes extremely expensive. In addition, it has also a problem that even though a microstructure is formed on a W substrate, which is a high temperature resistant material, the microstructure on the surface of W is melted and destroyed at a heating temperature of about 1000° C.

An object of the present invention is to provide a light source device comprising a filament showing high electric power-to-visible light conversion efficiency.

Means for Achieving the Object

In order to achieve the aforementioned object, the present invention provides, as the first embodiment, a light source device comprising a translucent gastight container, a filament disposed in the translucent gastight container, and a lead wire for supplying an electric current to the filament, wherein the filament comprises a substrate formed with a metal material and a visible light-absorbing film covering the substrate, and the visible light-absorbing film is transparent to lights of infrared region.

The present invention also provides, as the second embodiment, a light source device comprising a translucent gastight container, a filament disposed in the translucent gastight container, and a lead wire for supplying an electric current to the filament, wherein the filament comprises a substrate formed with a metal material and an infrared light-reflecting film covering the substrate.

Effect of the Invention

According to the present invention, infrared light radiation can be reduced and visible light radiation can be enhanced with a filament showing a high reflectance for the infrared wavelength region and a low reflectance for the visible light wavelength region, and therefore a light source device showing a high visible luminous efficiency can be obtained.

BRIEF DESCRIPTION OF THE DRAWINGS

FIG. 7 is an explanatory table showing types of layer structure and reflection characteristics of the infrared light-reflecting films 20 and visible luminous efficiency values, of the filaments of Examples 1 to 9.

MODES FOR CARRYING OUT THE INVENTION

The operating principle of the filament for light sources of the present invention will be explained with reference to the drawings.

Figure 1:
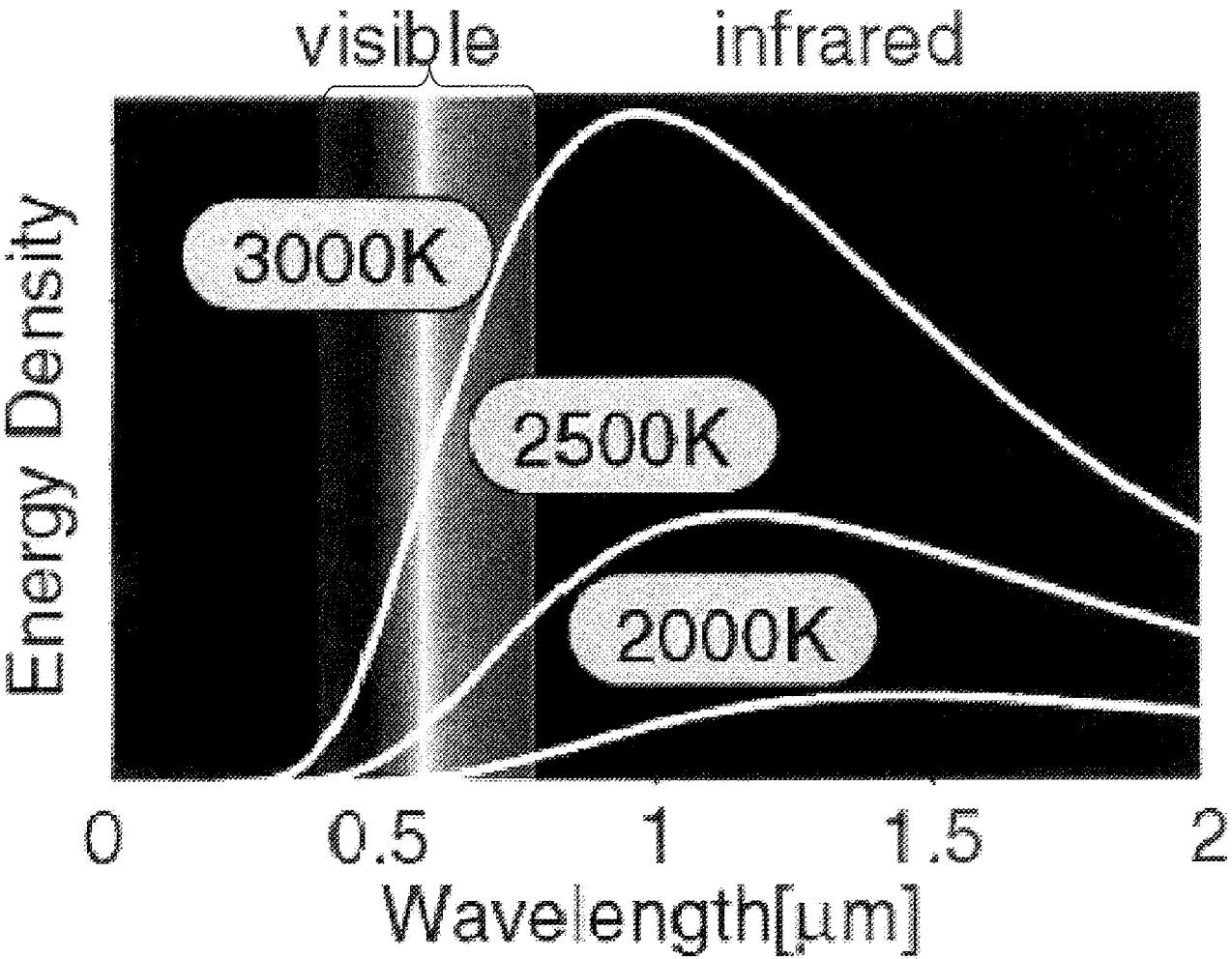
FIG. 1 is a graph showing wavelength dependency of radiation energy of a conventional tungsten filament.
Figure 2:
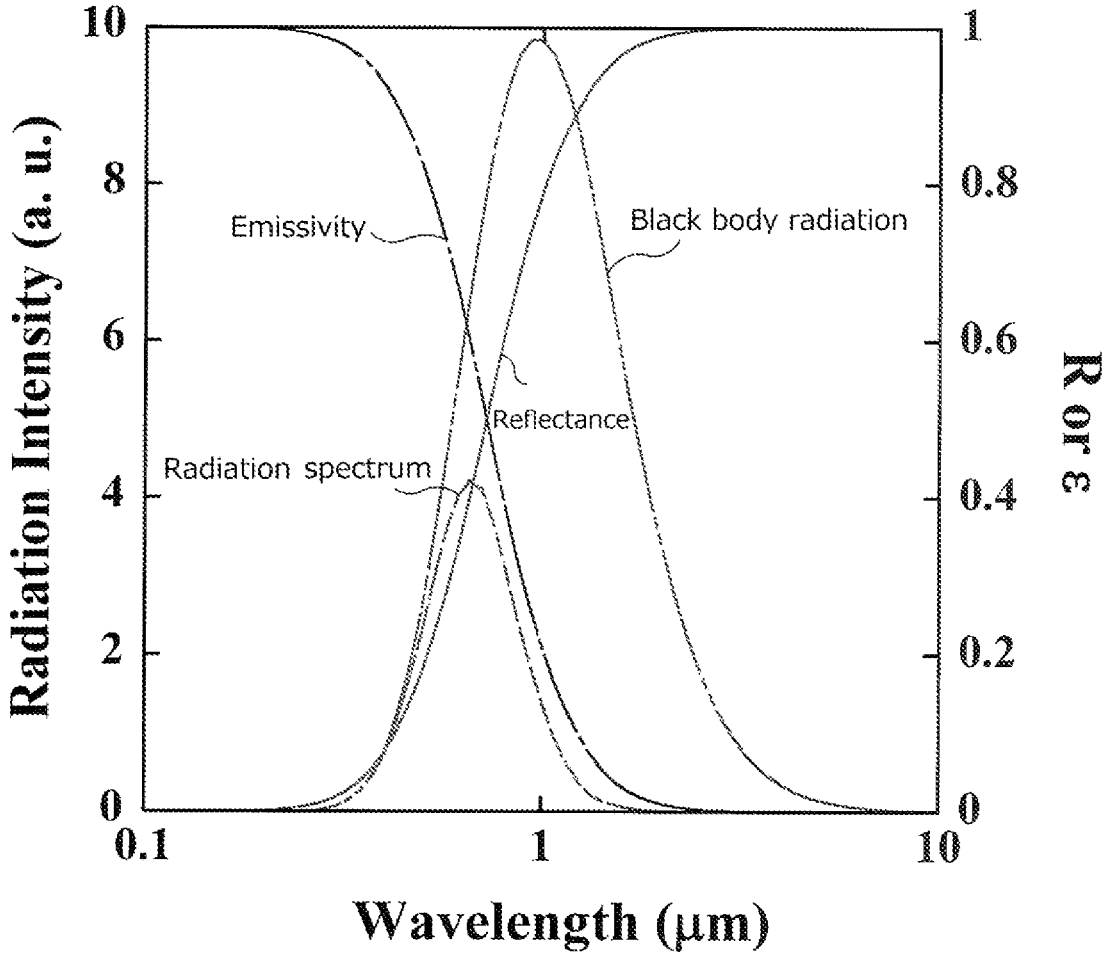
FIG. 2 is a graph showing relation of reflectance, emissivity, and radiation spectrum of a filament of the present invention.

As shown with the solid line in FIG. 2, the filament of the present invention shows a low reflectance close to 0% for lights of the visible region, and a reflectance close to 100% for lights of the infrared region. Specifically, it desirably shows a low reflectance of 20% or lower for lights of a visible region of wavelengths of 700 nm or shorter, and a high reflectance of 90% or higher for lights of the infrared region. Further, the reflectance desirably monotonously increases from the shorter wavelength side toward the longer wavelength side between the aforementioned ranges, as shown in FIG. 2. This filament highly efficiently emits visible lights when it is heated by supply of an electric current or the like. The principle for the above characteristic will be explained below on the basis of the Kirchhoff's law for black body radiation.

Loss of energy from the input energy induced by a material (filament in this case) in an equilibrium state under conditions of no natural convection heat transfer (for example, in vacuum) is calculated in accordance with the following equation (1).

[Equation 1]

$$P(\text{total})=P(\text{conduction})+P(\text{radiation}) \tag{1}$$

In the above equation, P(total) represents total input energy, P(conduction) represents energy lost through the lead wires for supplying electric current to the filament, and P(radiation) represents energy lost from the filament due to radiation of light to the outside at the heated temperature. At a high temperature of the filament of 2500K or higher, the energy lost from the lead wires becomes as low as only 5%, and the remaining energy corresponding to 95% or more of the input energy is lost due to the light radiation to the outside. And therefore almost all the input electric energy can be converted into light. However, visible light components of radiation lights radiated from a conventional general filament consist of only about 10%, and most of them consist of infrared radiation components. Therefore, such a filament as it is cannot serve as an efficient visible light source.

The term of P(radiation) in the aforementioned equation (1) can generally be described as the following equation (2).

[Equation 2]

$$P(\text{Radiation}) = \int_0^\infty \varepsilon(\lambda)\frac{\alpha\lambda^{-5}}{\exp(\beta/\lambda T)-1}d\lambda \tag{2}$$

In the equation (2), $\in(\lambda)$ is emissivity for each wavelength, the term of $\alpha\lambda^{-5}/(\exp(\beta/\lambda T)-1)$ represents the Planck's law of radiation, $\alpha=3.747\times10^8$ W$\mu$m$^4$/m$^2$, and $\beta=1.4387\times10^4$ $\mu$mK. The relation of $\in(\lambda)$ and the reflectance $R(\lambda)$ is described as the equation (3) according to the Kirchhoff's law.

[Equation 3]

$$\in(\lambda)=1-R(\lambda). \tag{3}$$

According to both the relations represented by the equations (2) and (3), $\in(\lambda)$ of a material showing the reflectance of 1 for all the wavelengths is 0 in accordance with the equation (3), thus the integral value in the equation (2) becomes 0, and therefore the material does not cause loss of energy due to radiation. The physical meaning of such a case as mentioned above is that P(total)=P(conduction) in such a case, extremely high temperature of the filament is attained even for a small amount of input energy. On the other hand, a material showing a reflectance of 0 for all the wavelengths is called perfect black body, and the value of $\in(\lambda)$ thereof is 1 in accordance with the equation (3). As a result, the integral value in the equation (2) is the maximum value in such a case, and therefore the amount of loss due to radiation becomes the maximum. The emissivity $\in(\lambda)$ of usual materials satisfies the condition of $0<\in(\lambda)<1$, and the wavelength dependency thereof is not so significant (but it shows mild dependencies on the wavelength $\lambda$ and the temperature T). Therefore, as for light radiation from the infrared region to visible region, such a material shows wide spectrum of light radiation from approximately visible region to the infrared region as represented by the spectrum shown in FIG. 2 with the two-dot chain line. The two-dot chain line shown in FIG. 2 is obtained by plotting the black body radiation spectrum under the condition of $\in(\lambda)=1$ for the total wavelength region for simplicity of the discussion.

On the other hand, heat radiation observed when a material showing approximately 0% of emissivity for the infrared region and approximately 100% of emissivity for the visible region of 700 nm or shorter as shown in FIG. 2 with an alternate long and short dash line heated in vacuum is represented by the following equation (4).

[Equation 4]

$$P(\text{Radiation}) = \int_0^{\infty} \varepsilon(\lambda)\theta(\lambda-\lambda_0)\frac{\alpha\lambda^{-5}}{\exp(\beta/\lambda T)-1}d\lambda \quad (4)$$

In the equation (4), $\theta(\lambda-\lambda_0)$ is a function which gives values like step function, i.e., gives a value of the emissivity of 0 for the region of wavelength on the longer wavelength side of a certain visible light wavelength $\lambda_0$, and a value of the emissivity of 1 for the region of wavelength on the shorter wavelength side of the certain wavelength $\lambda_0$. The radiation spectrum to be obtained has a shape obtained by convoluting the shape of the emissivity curve like that of a step function and the shape of the black body radiation spectrum, and the result of the calculation is the spectrum shown in FIG. 2 with the broken line. That is, the physical meaning of the equation (4) is as follows. Namely, in the low temperature region where small energy is input into the filament, the radiation loss is suppressed, the value of the term P(radiation) in the equation (4) is 0, therefore the energy loss consists only of P(conduction), and the filament temperature extremely efficiently rises. On the other hand, in such a temperature region that the filament temperature becomes high, and the peak wavelength of the black body radiation spectrum is shorter than $\lambda_0$, the energy input into the filament is lost as visible light radiation as represented by the radiation spectrum shown in FIG. 2 with the broken line.

As described above, $\theta(\lambda-\lambda_0)$ in the equation (4) represents a function which gives a value of the emissivity of 0 for the region of wavelength from longer wavelength to a certain visible light wavelength $\lambda_0$, and the value of the emissivity of 1 for the region of wavelength shorter than the certain wavelength $\lambda_0$. A material to which such a function is applied shows reflectance of 0 for the region of wavelength not longer than $\lambda_0$ and reflectance of 1 for the region of wavelength longer than $\lambda_0$ as shown in FIG. 2 with the solid line according to the Kirchhoff's law represented by the equation (3). Therefore, the present invention provides a filament that shows a reflectance close to 0 for lights of the visible region of a wavelength not longer than $\lambda_0$, and a reflectance close to 1 for lights of a wavelength longer than $\lambda_0$. Specifically, the present invention provides a filament that shows a low reflectance of 20% or lower for lights of a visible region of a wavelength not longer than $\lambda_0$, and a high reflectance of 90% or higher for lights of a predetermined infrared region of a wavelength longer than $\lambda_0$. The visible region of a wavelength not longer than $\lambda_0$ is preferably a region of wavelengths not longer than 750 nm and not shorter than 380 nm, more preferably a region of wavelengths not longer than 700 nm and not shorter than 380 nm. The predetermined infrared region of wavelengths longer than $\lambda_0$ for which the reflectance is 90% or higher is preferably an infrared region of wavelengths of 4000 nm or longer, and if the reflectance is 90% or higher for lights of an infrared region of wavelengths of 1000 nm or longer, further improvement of the luminous efficiency can be expected, and therefore such a characteristic is more preferred. In addition, so long as the reflectance is 20% or lower for the visible region, the reflectance may exceed 20% for the region of wavelengths shorter than those of visible region. Further, since there is a region where the reflectance changes from 20% or lower to 90% or higher exists between the visible region for which the reflectance is 20% or lower and the infrared region for which the reflectance is 90% or higher, and the reflectance for this region may be smaller than 90%. Therefore, for the wavelength region not shorter than 750 nm and not longer than 4000 nm, the reflectance may be higher than 20% and lower than 90%.

It is known that conventional filaments for light sources such as incandescent light bulbs are heated to a high temperature of 2000 to 3000K. According to the present invention, a filament for light sources that shows the aforementioned wavelength dependency of reflectance at a high temperature of 2000K or higher is provided.

The inventors of the present invention searched for conventional techniques that may be used to obtain a material (filament) showing such a reflectance characteristic as mentioned above, and found that the following methods (a) to (d) were already known. However, as a result of detailed investigation of these methods, it was found that the materials obtained by these methods could not bear a temperature of 1000° C. or higher, and could not attain the above-mentioned reflection characteristics (reflectance of 20% or lower for the visible region of wavelength $\lambda_0$ not longer than 700 nm, and reflectance of 90% or higher for the infrared region) at a temperature of 2000K or higher.

(a) A method of coating a substrate with a chromium film, nickel film, or the like by using such a technique as electroplating (refer to, for example, G. Zajac, et al., J. Appl. Phys., 51, 5544 (1980))

(b) A method of anodizing aluminum to produce a porous nanostructure on the surface with controlled pore diameter and depth, and thereby control the reflectance (refer to, for example, A. Anderson, et al., J. Appl. Phys., 51, 754 (1980))

(c) A method of forming a composite thin film consisting of a dielectric substance containing metal microparticles (the composite thin film is produced by a method of depositing a metal such as Cu, Cr, Co and Au, or a semiconductor such as PbS and CdS simultaneously with a dielectric substance such as those consisting of oxide or fluoride by vapor deposition, sputtering or ion implantation) (for example, J. C. C. Fan and S. A. Spura, Appl. Phys. Lett., 30, 511 (1977))

(d) A method of producing a photonic crystal structure on a surface of metal or semiconductor to control the reflectance thereof (for example, F. Kusunoki et al., Jpn. J. Appl. Phys., 43, 8A, 5253 (2004))

According to the present invention, a high melting point material (melting point is 2000K or higher) showing a high reflectance for infrared wavelengths is used as a substrate of a filament, and the substrate is coated with at least one of a visible light-absorbing film that reduces reflectance for visible region and an infrared light-reflecting film that increases reflectance for infrared lights.

Figure 3:
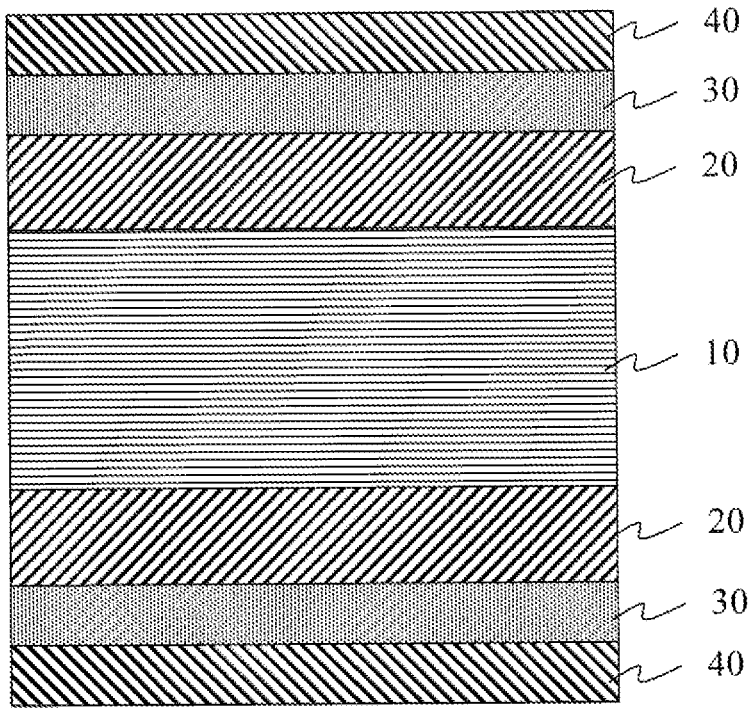
FIG. 3 is a sectional view of an exemplary filament of the present invention.

Hereafter, there will be explained a filament in which a substrate 10 is coated with an infrared light-reflecting film 20, a visible light-absorbing film 30, and a visible light antireflection coating film 40 in this order as shown in FIG. 3, as an example.

(Design of Substrate 10)

The high melting point material for constituting the substrate is preferably a metallic substance showing a melting point of 2000K or higher. For example, any of HfC (melting point, 4160K), TaC (melting point, 4150K), ZrC (melting point, 3810K), C (melting point, 3800K), W (melting point, 3680K), Re (melting point, 3453K), Os (melting point, 3327K), Ta (melting point, 3269K), Mo (melting point, 2890K), Nb (melting point, 2741K), Ir (melting point, 2683K), Ru (melting point, 2583K), Rh (melting point, 2239K), V (melting point, 2160K), Cr (melting point, 2130K), Zr (melting point, 2125K), and an alloy containing any of these can be used.

Shape of the substrate 10 may be any shape that allows to be heated to a high temperature, and it may be in the form of, for example, wire, rod or thin plate, which can generate heat in response to supply of electric current from a lead wire. Further, the substrate 10 may have a structure that allows to be heated directly by the method except the electric current.

The surface of the substrate is desirably mirror-polished. Specifically, the surface of the substrate preferably satisfies at least one of the following conditions: surface roughness (center line average height Ra) of 1 μm or smaller, maximum height (Rmax) of 10 μm or smaller, and ten-point average roughness (Rz) of 10 μm or smaller. This is because reflectance of a metal material generally correlates with surface roughness thereof, and a larger surface roughness provides a lower reflectance decreased from that of a mirror surface.

Figure 4:
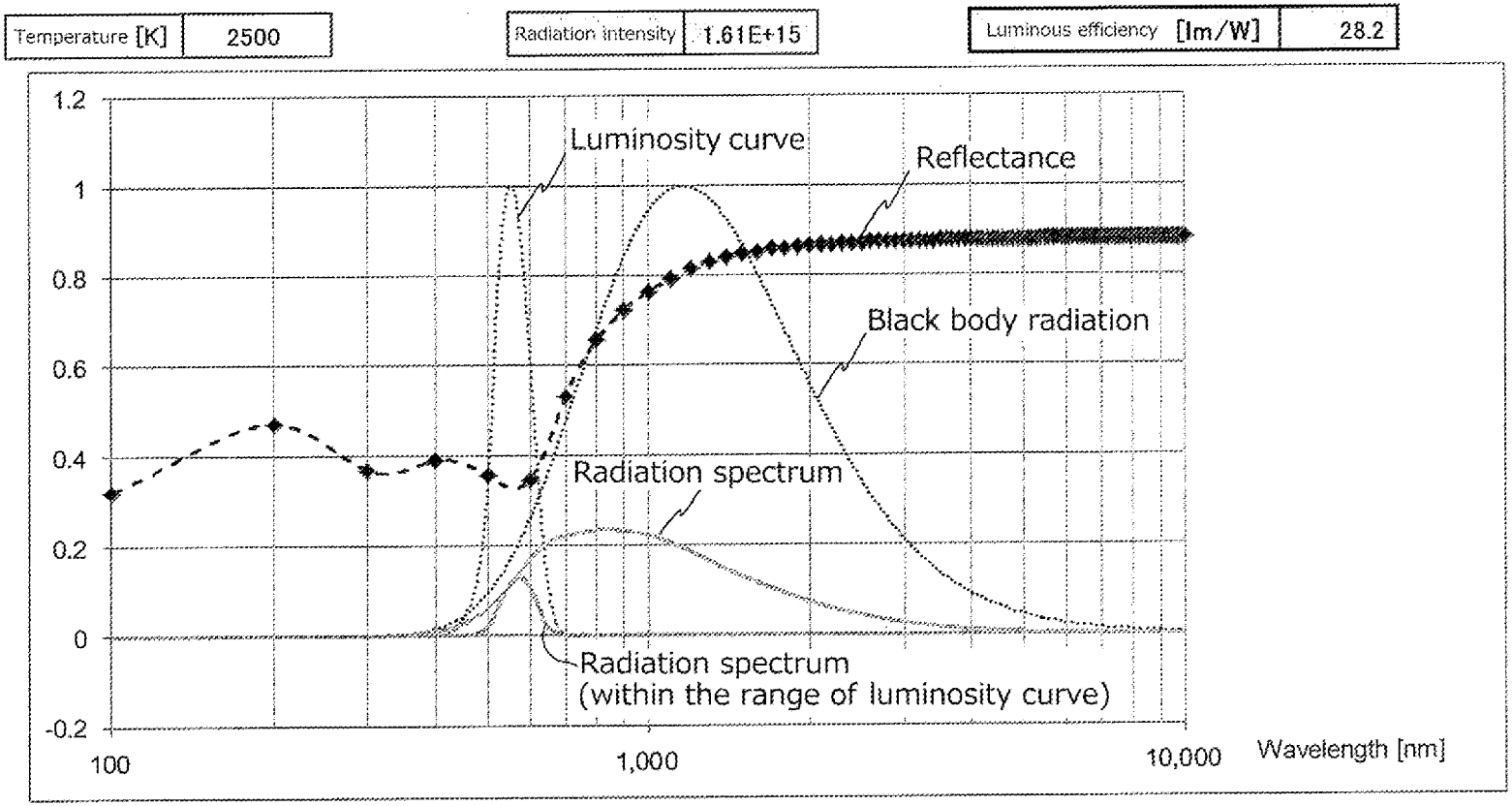
FIG. 4 is a graph showing the wavelength dependency of the reflectance, radiation spectrum, and spectral luminous intensity (radiation spectrum×luminosity curve) observed for the Ta substrate used in the examples before polishing.
Figure 5:
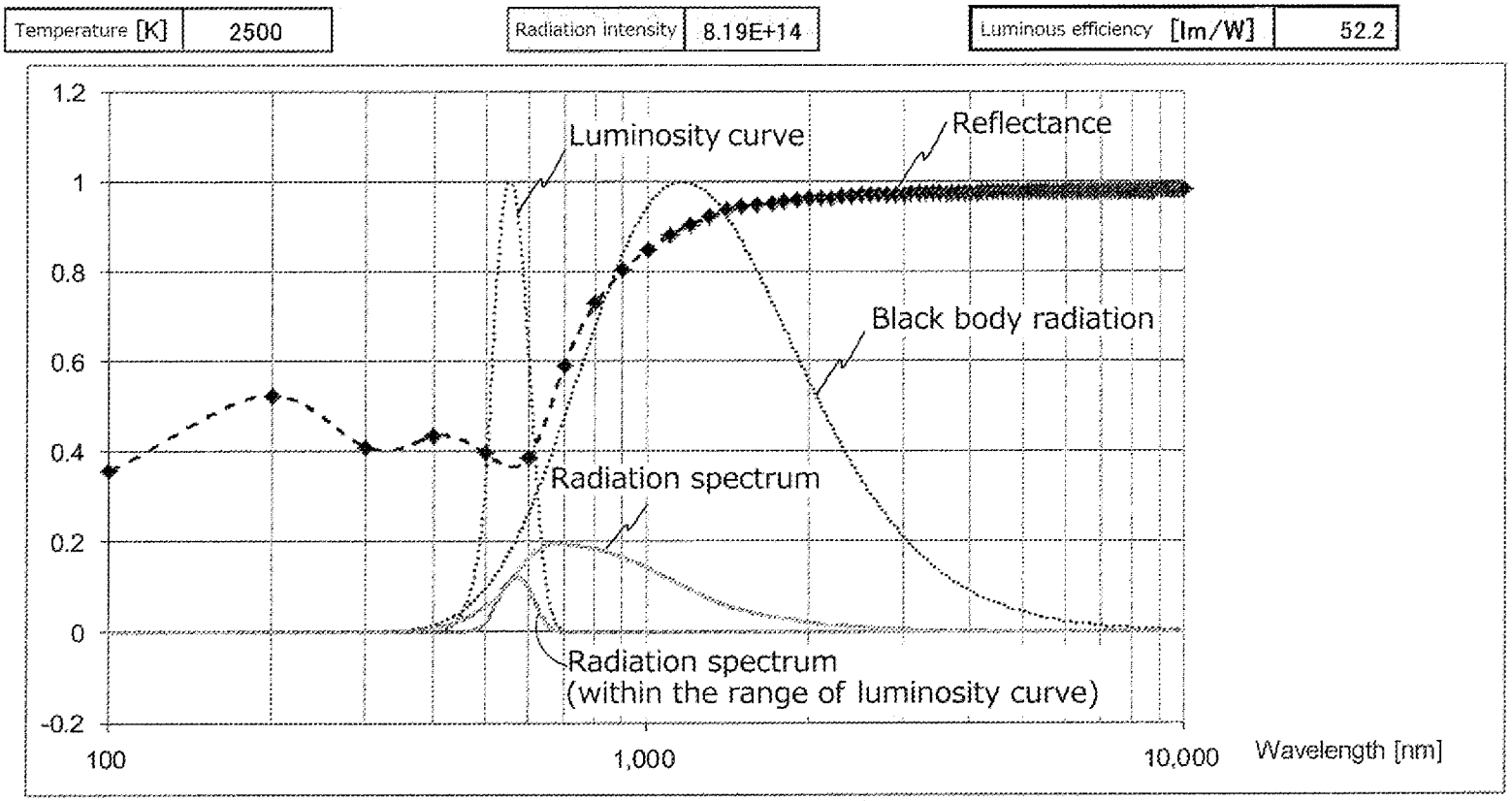
FIG. 5 is a graph showing the wavelength dependency of the reflectance, radiation spectrum, and spectral luminous intensity (radiation spectrum×luminosity curve) observed for the Ta substrate used in the examples after polishing.

FIG. 4 is a graph showing wavelength dependency of reflectance of a Ta substrate 10 before mirror polishing rough surface, and FIG. 5 is a graph showing wavelength dependency of reflectance of a Ta substrate 10 after mirror polishing satisfying the above-mentioned surface roughness condition. As shown in FIG. 5, the reflectance for the infrared region of the Ta substrate after mirror polishing is improved by 10% or more compared with the reflectance observed before the polishing shown in FIG. 4. Since a higher reflectance provides more reduced emission of long wavelength infrared lights, the luminous efficiency can be increased by mirror-polishing the substrate 10. More specifically, for the Ta substrate, as shown in FIGS. 4 and 5, the reflectance of the mirror surface (98%) is improved by about 10% compared with the reflectance of the rough surface (88%) for the infrared wavelength region of 1 to 10 μm. Further, as seen in the wavelength dependency of the emissivity of the Ta substrate 10 not coated shown in FIGS. 4 and 5, the emissivity of the mirror-polished Ta substrate 10 decreases for the infrared wavelength region. Therefore, as for visible luminous efficiency for the temperature of 2500K, the visible luminous efficiency of the mirror-polished Ta substrate 10 is 52.2 lm/W, which is improved as much as 46% compared with the visible luminous efficiency of the rough surface Ta substrate 10, 28.2 lm/W.

As described above, for the filament of the present invention, a high temperature resistant material of which reflectance is increased as much as possible for the infrared wavelength region of 1 to 10 μm is desired, and therefore it is desirable to subject the surface of the substrate 10 to mirror surface processing. Decreased reflectance of a rough surface occurs due to multiple scattering and absorption of lights induced by the rough surface structure.

(Design of Infrared Light-Reflecting Film 20)

Figure 6:
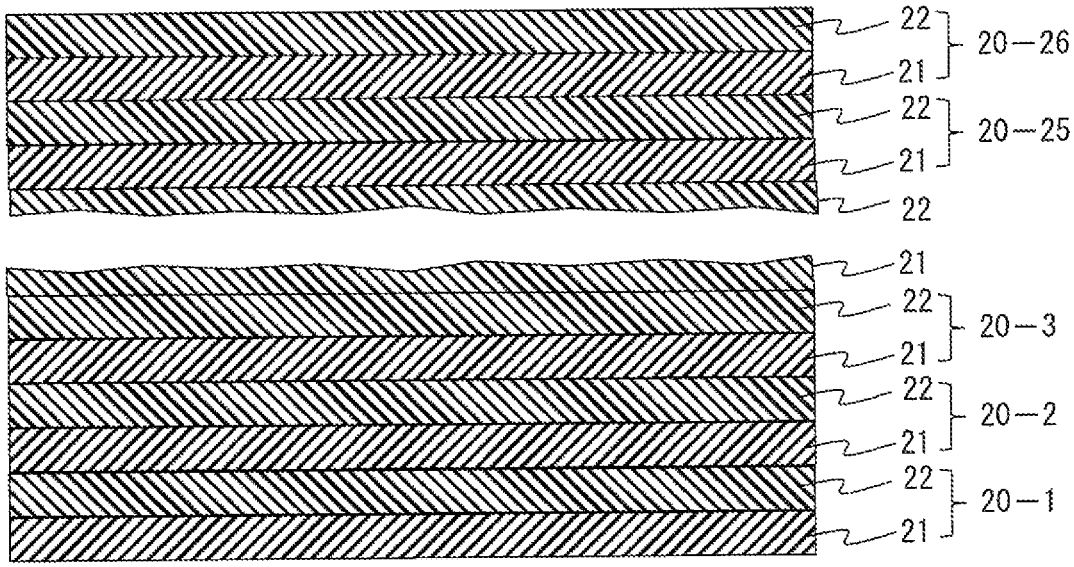
FIG. 6 is a sectional view of the infrared light-reflecting film 20 of the filament of the examples.

The infrared light-reflecting film 20 is disposed in order to reflect infrared lights and thereby enhance the reflectance of the filament for the infrared wavelength region. As shown in FIG. 6, the infrared light-reflecting films 20 comprises at least one set of a first layer 21 and a second layer 22, both of which are constituted with a material that transmits infrared lights, for example, a high temperature resistant dielectric layer. If refractive index and thickness of the first layer 21 are represented as $n_1$ and $d_1$, respectively, and refractive index and thickness of the second layer 22 are represented as $n_2$ and $d_2$, respectively, they satisfy the condition of the formula (5) for a predetermined wavelength λ of infrared light.

[Equation 5]

$$n_1 \cdot d_1 = n_2 \cdot d_2 = \lambda/4 \quad (5)$$

By laminating two kinds of the layers 21 and 22 showing different refractive indexes, the reflectance for infrared lights of a predetermined wavelength range around a predetermined center wavelength $\lambda_1$ can be increased by utilizing interference of lights.

Further, in this example, in order to reflect infrared lights of a wide wavelength range, a plurality of sets of two kinds of the layers 21 and 22 are laminated as the infrared light-reflecting film 20 as shown in FIG. 6. By using a plurality of sets of the layers showing different center wavelengths λ of lights to be reflected by the layers so that infrared lights of slightly different wavelengths are reflected by the plurality of sets of the layers, respectively, the infrared light-reflecting film 20 as a whole can reflect infrared lights of a wide wavelength range. Since a larger difference of the refractive indexes of the first layer 21 and the second layer 22 provides a larger wavelength range for which lights can be reflected, the materials of the first layer 21 and the second layer 22 are selected depending on the wavelength region for which lights are desired to be reflected. When a plurality of sets of the layers 21 and 22 are laminated, the center wavelengths of all the sets may not necessarily be different, and it is sufficient that infrared lights of a desired wavelength region can be reflected by all of the plurality of sets of the layers. Therefore, center wavelengths of some sets among the plurality of sets may be the same, and for example, every 2 sets of the layers may reflect lights of the same center wavelength.

For example, an MgO layer is used as the first layer 21, and an SiC layer is used as the second layer 22. Since radiation from a black body at a temperature of 2500K has a peak at an infrared wavelength of about 1200 nm, by choosing a wavelength around this peak to enhance reflection of lights of this wavelength range, the luminous efficiency can be improved. If 26 sets of the first layer 21 and the second layer 22 (sets 20-1 to 20-26), 52 layers in total, are laminated, and for example, the thicknesses of the MgO layers 21 and the SiC layers 22 are designed to be different for every set, and gradually change in the ranges of 156 to 94 nm and 116 to 70 nm, respectively, favorable infrared reflection characteristics can be obtained for the range of a center wavelength $\lambda_1$ to $\lambda_{26}$ of 700 nm to 10 μm.

The aforementioned first layer 21 and second layer 22 can be constituted with any of the materials $SiO_2$, MgO, $ZrO_2$, $Y_2O_3$, 6H—SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$ and $ZrB_{12}$, or a mixed crystal material containing these materials.

In the above explanation, an example where the combinations of the materials constituting the first layer 21 and the second layer 22 are the same for all the sets 20-1 to 20-26 is explained. However, the present invention is not limited to such a configuration, and the combinations of the materials of the first layer 21 and the second layer 22 may of course be different for every set.

The difference of the refractive indexes of the first layer 21 and the second layer 22 is preferably 0.1 or larger, since such a difference can provide favorable reflectance characteristics. Since a larger difference of the refractive indexes provides a larger wavelength range for which one set of the first layer 21 and second layer 22 can reflect lights, and thus can more reduce the total number of the layers to be laminated, the difference of the refractive indexes is especially preferably 0.3 or larger.

Favorable reflectance characteristics can be obtained with a total number of the layers to be laminated of 3 to 200 layers for the lamination of the sets of the first layer 21 and the second layer 22. If the number of the layers exceeds 200, cracks and separations are caused by stress and so forth, and it becomes difficult to maintain favorable reflectance characteristics. Therefore, it is desirable to adopt a film formation technique that can prevent such phenomena in such s case.

(Design of Visible Light-Absorbing Film 30)

The visible light-absorbing film 30 is disposed on the aforementioned infrared light-reflecting film 20. The visible light-absorbing film 30 is a film transparent to infrared lights and showing a high absorption rate for visible lights, and has an action of reducing the reflectance of the filament for the visible light wavelength region by absorbing visible lights.

The visible light-absorbing film 30 is constituted with a material transparent to lights of the infrared region, for example, a highly heat resistant dielectric material to which metal microparticles are added, or a material transparent to lights of the infrared region, which is doped with impurities.

In the case of the former material containing metal microparticles, visible lights can be absorbed by the localized light absorption action of the metal microparticles. Typical examples of such a material utilizing localized light absorption action of the metal microparticles include stained glass seen in churches. Since absorption wavelength and absorption amount for lights of the visible region of such a material can be controlled by choosing type and particle diameter of the metal dispersed in the glass, various kinds of absorption bands can be formed in such a manner as in stained glass. For example, color of stained glass can be changed from pink to dark green by using microparticles of Au and changing the particle size thereof from 2 to 5 nm, and in the physical sense, this phenomenon is caused by change of color of transmitting lights induced by the localized resonance absorption effect for lights (complementary color) exerted at the surfaces of the metal microparticles. That is, the microparticles having a small particle size absorb lights of short wavelengths, and those having a larger particle size absorb lights of longer wavelengths. The material transparent to infrared lights containing metal microparticles can absorb lights according to the same principle.

The particle size of the metal microparticles is desirably not smaller than 2 nm and not larger than 5 μm. Addition amount of the metal microparticles is preferably not smaller than 0.0001% and not larger than 10%. The metal microparticles desirably have a melting point of 2000K or higher, which is a temperature of the filament for light emission, and they are desirably microparticles of, for example, any of W, Ta, Mo, Au, Ag, Cu, Al, Ti, Ni, Co, Cr, Si, V, Mn, Fe, Nb, Ru, Pt, Pd, Hf, Y, Zr, Re, Os, Ir, and an alloy containing these metals.

The latter material transparent to lights of the infrared region and doped with impurities can absorb visible lights by the same physical effect as that exerted by a fluorescent material. Such absorption is obtained by the energy levels formed by atoms (ions) added to the material transparent to lights of the infrared region. Typical examples of such an action include the physical processes of light absorption utilizing a transition metal, and light absorption utilizing a rare earth metal. As for the condition for absorption of lights by this action, the elements added to the material transparent to lights of the infrared region must be dispersed as atoms (ions), unlike the aforementioned metal microparticles. Specifically, Ce, Eu, Mn, Ti, Sn, Tb, Au, Ag, Cu, Al, Ni, W, Pb, As, Tm, Ho, Er, Dy, Pr, and so forth can be used as the impurities. Addition concentration of the impurities is preferably not lower than 0.0001% and not higher than 10%.

As the material transparent to lights of the infrared region for constituting the visible light-absorbing film 30, there can be used any of the materials $SiO_2$, MgO, $ZrO_2$, $Y_2O_3$, 6H—SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$ and $ZrB_{12}$, or a material containing these materials.

For example, as the visible light-absorbing film 30, an SiC film to which metal microparticles or impurities are added can be used. Thickness of this visible light-absorbing film 30 is desirably designed so that reflectance for visible lights becomes 0.05 or less. Since the reflectance of the Ta substrate 10 not coated with the visible light-absorbing film 30 is about 0.4 for light of a wavelength of 550 nm, if the transmissivity of the visible light-absorbing film 30 is made to be 0.35 or smaller, the reflectance of the substrate 10 can be decreased to 0.4×0.35×0.35=0.049 for the light that goes and comes back in the visible light-absorbing film, and thus the reflectance of the Ta substrate 10 coated with the visible light-absorbing film 30 can be made to be lower than 0.05.

In addition, when the extinction coefficient of the visible light-absorbing film 30 is represented by k, thickness d of the visible light-absorbing film 30 required for obtaining the transmissivity of the visible light-absorbing film 30 of 0.35 is represented by the following equation (6).

[Equation 6]

$$d = -\frac{\lambda}{4\pi k}\log 0.35 \tag{6}$$

Therefore, the thickness of the visible light-absorbing film 30 is designed according to the equation so that the required transmissivity can be obtained. For example, when the extinction coefficient k of the visible light-absorbing film 30 for light of a wavelength of 550 nm is 0.1, the thickness d required for obtaining the transmissivity of 0.35 is 200 nm.

As the method for forming the visible light-absorbing film 30 to which metal microparticles are added, there can be used a method of performing vapor codeposition of the microparticles at the time of forming a film of a dielectric material (SiC) transparent to infrared lights, which constitutes the film 30, or a method of coating a film of the aforementioned dielectric material transparent to infrared lights, and then adding metal microparticles by ion implantation. Specifically, in the case of the former method, for example, there is used a method comprising preparing SiC and the metal particle material Ta as the deposition sources, mixing the metal particle material at a ratio not smaller than 0.0001% and not larger than 10% in SiC, heating the mixed material with electron beam to simultaneously vapor-deposit them on the substrate, and then sintering the substrate having the deposited materials to grow crystals of the material of the metal microparticles in the transparent dielectric material. In the case of the latter method, there is used a method of preparing SiC as a deposition source, forming a SiC film, then injecting Ta metal ions as the metal particle material by using an ion implantation apparatus, and sintering the substrate having the SiC film to grow crystals of the material of the metal microparticles in the transparent dielectric material.

(Design of Visible Light Antireflection Coating Film 40)

On the visible light-absorbing film 30, the visible light antireflection coating film 40 is disposed. The visible light antireflection coating film 40 is a film which acts to reduce the reflectance for visible lights.

The visible light antireflection coating film 40 is transparent to visible lights, and reduces the reflectance of the filament by interference of visible lights reflected by the surface of the visible light antireflection coating film 40, and visible lights which transmit the visible light antireflection coating film 40 and are reflected by the lower surface thereof (interface with the visible light-absorbing film 30).

Film thickness of the visible light antireflection coating film is designed to be an appropriate thickness according to the refractive index of the material thereof by calculation, experimentally, or by simulation. When the thickness is designed by calculation, the thickness is determined so that, for example, the optical path length for visible light ($\lambda/n_0$, $n_0$ is refractive index of the visible light antireflection coating film) corresponds to about ¼ of the wavelength. When it is designed experimentally or by simulation, there is used a method of determining thickness dependency of the reflectance of the filament by obtaining reflectance values for various thickness values, and then obtaining a thickness providing the lowest reflectance for all the wavelengths of visible lights.

The visible light antireflection coating film 40 is constituted with a film of a dielectric material showing a melting point of 2000K or higher. For example, any of metal oxide film, metal nitride film, metal carbide film and metal boride film showing a melting point of 2000K or higher is used. Specifically, there can be used a single layer film of any of $SiO_2$, MgO, $ZrO_2$, $Y_2O_3$, 6H—SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$ and $ZrB_{12}$, or a multi-layer film comprising a plurality of single layer films of any of these materials.

Specifically, as the visible light antireflection coating film 40, for example, an MgO film is coated in a thickness of about 80 nm. The optical thickness of this MgO thin film is ¼ of a wavelength of 550 nm, and therefore it can reduce the reflectance for light of a wavelength of 550 nm by optical interference. Further, in order to make the wavelength range for which the reflectance is low larger, it is also possible to constitute it with a multi-layer film of MgO and SiC thin films.

As the methods for forming films for the aforementioned infrared light-reflecting film 20, visible light absorbing film 30, and the visible light antireflection coating film 40, it is possible to use various methods, such as electron beam deposition method, sputtering method, and chemical vapor deposition method. After the film formation, in order to enhance adhesion of the film to the surface of the substrate 10, and enhance film properties (crystallinity, optical characteristics, etc.), it is preferable to perform annealing in a temperature range of 1500 to 2500° C.

As described above, with the filament of the present invention, reflection characteristics consisting of suppressed low reflectance for lights of the visible region and increased reflectance for lights of the infrared region can be obtained by coating the substrate 10 with the infrared light-reflecting film 20, the visible light-absorbing film 30, and the visible light antireflection coating film 40 in this order.

Specific Examples

As the filaments of Examples 1 to 9 as specific examples, there are prepared filaments in which the substrate is constituted with Ta, and 9 kinds of combinations described later of the materials of the first layer 21 and the second layer 22 of the infrared light-reflecting film 20 are used.

In all the examples, as the visible light-absorbing film 30, an SiC film to which Ta metal microparticles (particle diameter, 3 nm) are added at a concentration of 0.1% is used. The thickness of the visible light-absorbing film 30 is about 200 nm. Further, as the visible light antireflection coating film 40, an MgO film is used, and the thickness thereof is 80 nm.

The substrate 10 is produced by a known process such as sintering and drawing of a material metal. The substrate is formed in a desired shape, for example, in the form of wire, rod, thin plate, or the like.

The surface of the substrate is polished with two or more kinds of diamond abrasive grains, and thereby processed into a mirror surface showing a center line average height (Ra) of 1 μm or smaller, a maximum height (Rmax) of 10 μm or smaller, and a ten-point average roughness (Rz) of 10 μm or smaller.

In Example 1, the infrared light-reflecting film 20 has a structure comprising 13 layers (sets) of films consisting of 2 sets of an SiC layer as the first layer 21 and an MgO layer as the second layer 22 laminated alternately (total 52 layers in terms of the numbers of single layers), as shown in FIG. 7. The center wavelength λ of each set is designed so that infrared lights of wavelengths of 700 nm to 10 μm are reflected by the total 52 layers.

In Examples 2 to 9, the second layer 22 and the first layer 21 are constituted with $SiC/ZrO_2$, $SiC/Y_2O_3$, $SiC/HfO_2$, $SiC/Lu_2O_3$, $SiC/Yb_2O_3$, $SiC/SiO_2$, $HfO_2/SiO_2$, and $Lu_2O_3/SiO_2$, respectively. The numbers of the laminated layers are the same as that of Example 1.

FIG. 7 shows the reflection characteristics (reflectance for light of 550 nm, and reflectance for light of 1 μm) obtained with the infrared light-reflecting films 20 used in Examples 1 to 9, and the wavelengths for which they show a reflectance of 50% (cut-off wavelengths).

FIG. 7 also shows the visible luminous efficiencies (2500K) obtained by simulation for the filaments of Examples 1 to 9 having the infrared light-reflecting film 20, the visible light-absorbing film 30, and the visible light antireflection coating film 40 on the mirror-polishing Ta substrate 10. As shown in FIG. 7, the filaments of Examples 1 to 9 show high visible luminous efficiencies as high as 75.4 to 113.0 lm/W, which is increased compared with the visible luminous efficiency of the mirror-polished Ta substrate 10, 52.2 lm/W. Thus, the filaments of Examples 1 to 9 show improved visible luminous efficiency.

Figure 8:
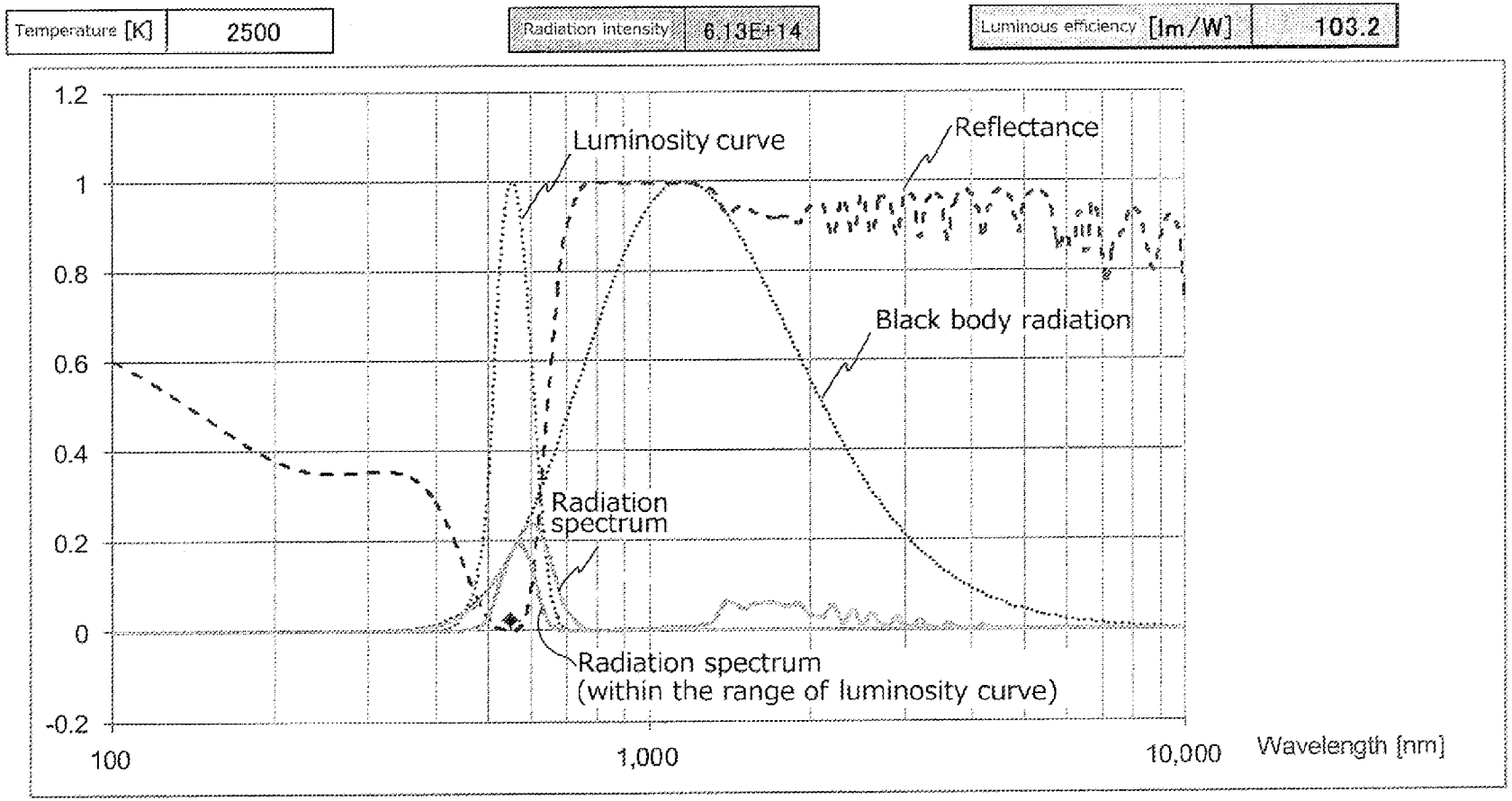
FIG. 8 is a graph showing the wavelength dependency of the reflectance, radiation spectrum, and spectral luminous intensity (radiation spectrum×luminosity curve) observed for the filament of the specific example, Example 1.

Further, FIG. 8 shows the reflectance and emissivity of the filament of Example 1 mentioned above. As clearly seen from FIG. 8, it can be confirmed that by providing the infrared light-reflecting film (SiC/MgO) 20, the visible light-absorbing film 30, and the visible light antireflection coating layer 40 on the mirror-polished Ta substrate 10 as in Example 1, there can be obtained a filament having reflection characteristics that the reflectance sharply changes from about 0.1 to about 1 in the wavelength range of 600 to 700 nm, and showing an extremely low reflectance as low as 0 to 0.1 for lights of the visible region, and a reflectance close to 1 for lights of a wide range of the infrared region. Therefore, it can be seen that the emissivity for the infrared region (2500K) can be suppressed to be small, and such a high visible luminous efficiency of 103.2 lm/W as mentioned above can be obtained.

Specific Example of Light Source Device

A light source device (incandescent light bulb) using such a filament as described in the aforementioned examples will be explained.

Figure 9:
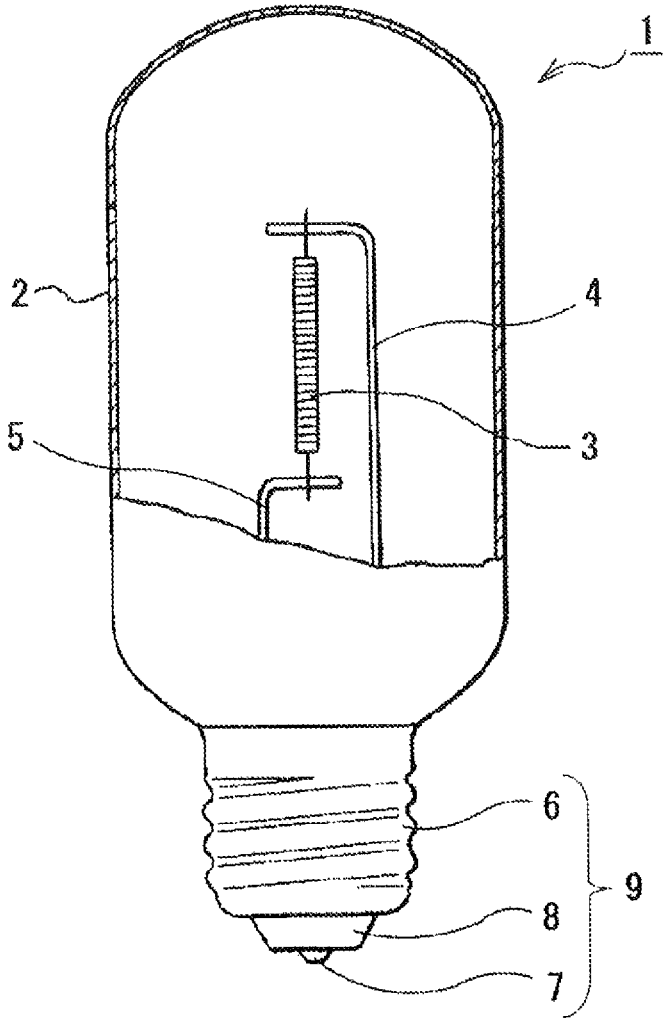
FIG. 9 is a broken sectional view of the incandescent lamp of the example.

FIG. 9 shows a broken sectional view of the incandescent light bulb using such a filament as described in the aforementioned examples. The incandescent light bulb 1 is constituted with a translucent gastight container 2, a filament 3 disposed in the inside of the translucent gastight container 2, and a pair of lead wires 4 and 5 electrically connected to the both ends of the filament 3 and supporting the filament 3. The translucent gastight container 2 is constituted with, for example, a glass bulb. The inside of the translucent gastight container 2 is maintained to be a high vacuum state of $10^{-1}$ to $10^{-6}$ Pa. If $O_2$, $H_2$, a halogen gas, an inert gas, or a mixed gas of these is introduced into the inside of the translucent gastight container 2 at a pressure of $10^{6}$ to $10^{-1}$ Pa, sublimation and degradation of the visible light antireflection coating film formed on the filament are suppressed, and therefore the lifetime-prolonging effect can be expected, as in the conventional halogen lamps.

A base 9 is adhered to a sealing part of the translucent gastight container 2. The base 9 comprises a side electrode 6, a center electrode 7, and an insulating part 8, which insulates the side electrode 6 and the center electrode 7. One end of the lead wire 4 is electrically connected to the side electrode 6, and one end of the lead wire 5 is electrically connected to the center electrode 7.

The filament 3 of this example is a filament having a structure of a wire wound into a spiral shape.

Since the filament 3 has the infrared light-reflecting film 20, the visible light-absorbing film 30, and the visible light antireflection coating film 40 on the substrate, it shows high reflectance for lights of the infrared region, and low reflectance for lights of the visible region. With such a configuration, high visible luminous efficiency (luminous efficiency) can be realized. Therefore, according to the present invention, with the simple configuration of providing the infrared light-reflection film on the surface of the filament, infrared radiation can be suppressed, and as a result, input electric power-to-visible light conversion efficiency can be increased. Therefore, an inexpensive and efficient energy-saving electric bulb for illumination can be provided.

In the examples mentioned above, the reflectance of the filament surface was improved by mechanical polishing. However, the means for improving the reflectance is not limited to mechanical polishing, and any other method can of course be used, so long as the reflectance of the filament surface can be improved. For example, there can be employed wet or dry etching, a method of contacting the filament with a smooth surface at the time of drawing, forging, or rolling, and so forth.

In the aforementioned examples, use of the filament of the present invention as a filament of an incandescent light bulb is explained. However, the filament of the present invention can also be used for purposes other than incandescent light bulbs. For example, by shifting the wavelength range of radiation from the visible region to the near infrared region by changing the configurations of the visible light-absorbing film 30 and the visible light antireflection coating film 40 through redesigning of the thickness, material, and addition concentration of impurities thereof, it can be used as an electric wire for heaters, electric wire for welding processing, electron source of thermoelectronic emission (X-ray tube, electron microscope, etc.), and so forth. Also in these cases, the filament can be efficiently heated to high temperature with a little input power because of the infrared light radiation suppressing action (in particular, suppression of the infrared light radiation at longer wavelength), and therefore the energy efficiency can be improved.

DESCRIPTION OF NUMERICAL NOTATIONS

1 . . . Incandescent light bulb, 2 . . . translucent gastight container, 3 . . . filament, 4 . . . lead wire, 5 . . . lead wire, 6 . . . side electrode, 7 . . . center electrode, 8 . . . insulating part, 9 . . . base

The invention claimed is:

1. A light source device comprising a translucent gastight container, a filament disposed in the translucent gastight container, and a lead wire for supplying an electric current to the filament, wherein:

the filament comprises a substrate formed with a metal material and a visible light-absorbing film covering the substrate, wherein the visible light-absorbing film is transparent to lights of infrared region;

the filament further comprises an infrared light-reflecting film; and the infrared light-reflecting film is disposed between the visible light-absorbing film and the substrate.

2. The light source device according to claim 1, wherein the visible light-absorbing film comprises a material that is transparent to the lights of infrared region and to which metal microparticles are added.

3. The light source device according to claim 2, wherein the metal microparticles have a particle diameter not smaller than 2 nm and not larger than 5 μm.

4. The light source device according to claim 2, wherein the metal microparticles are metal microparticles containing any of W, Ta, Mo, Au, Ag, Cu, Al, Ti, Ni, Co, Cr, Si, V, Mn, Fe, Nb, Ru, Pt, Pd, Hf, Y, Zr, Re, Os, and Ir.

5. The light source device according to claim 2, wherein the material transparent to the lights of infrared region comprises any of $SiO_2$, MgO, $ZrO_2$, $Y_2O_3$, 6H-SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$ and $ZrB_{12}$.

6. The light source device according to claim 1, wherein the visible light-absorbing film comprises a material that is transparent to the lights of infrared region and that is doped with impurities.

7. The light source device according to claim 6, wherein the impurities are any of Ce, Eu, Mn, Ti, Sn, Tb, Au, Ag, Cu, Al, Ni, W, Pb, As, Tm, Ho, Er, Dy, and Pr.

8. The light source device according to claim 6, wherein the material transparent to the lights of infrared region comprises any of $SiO_2$, MgO, $ZrO_2$, $Y_2O_3$, 6H-SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$ and $ZrB_{12}$.

9. The light source device according to claim 1, wherein the filament further comprises a visible light antireflection coating film for reducing visible light reflectance.

10. The light source device according to claim 1, wherein the substrate contains one of HfC, TaC, ZrC, C, W, Re, Os, Ta, Mo, Nb, Ir, Ru, Rh, V, Cr, and Zr.

11. The light source device according to claim 1, wherein the infrared light-reflecting film comprises a material that transmits infrared lights and comprises a set of laminated first and second layers, and wherein if a refractive index and a thickness of a first layer are represented as $n_1$ and $d_1$, respectively, and a refractive index and a thickness of a second layer are represented as $n_2$ and $d_2$, respectively, then $n_1$, $d_1$, $n_2$ and $d_2$ satisfy:

$$n_1 \cdot d_1 = n_2 \cdot d_2 = \lambda_1/4,$$

for infrared light of a predetermined wavelength $\lambda_1$, so that the infrared light-reflecting film reflects the infrared light of the predetermined wavelength $\lambda_1$.

12. The light source device according to claim 9, wherein the visible light antireflection coating film comprises at least one layer of a material transparent to visible lights, and wherein an optical thickness of said at least one layer for a predetermined visible light wavelength is ¼ of the predetermined visible light wavelength.

13. The light source device according to claim 9, wherein the visible light antireflection coating film is a multi-layer film consisting of a plurality of laminated layers each constituted with a material transparent to visible lights.

14. The light source device according to claim 9, wherein the visible light antireflection coating film comprises at least one layer of a material which is transparent to visible lights, and which comprises any of $SiO_2$, MgO, $ZrO_2$, $Y_2O_3$, 6H-SiC (hexagonal SiC), GaN, 3C-SiC (cubic SiC), $HfO_2$, $Lu_2O_3$, $Yb_2O_3$, graphite, diamond, $CrZrB_2$, MoB, $Mo_2BC$, $MoTiB_4$, $Mo_2TiB_2$, $Mo_2ZrB_2$, $MoZr_2B_4$, NbB, $Nb_3B_4$, $NbTiB_4$, $NdB_6$, $SiB_3$, $Ta_3B_4$, $TiWB_2$, $W_2B$, WB, $WB_2$, $YB_4$ and $ZrB_{12}$.

15. The light source device according to claim 9, wherein the visible light antireflection coating film is disposed to constitute an outermost surface of the filament.

16. A light source device comprising a translucent gastight container, a filament disposed in the translucent gastight container, and a lead wire for supplying an electric current to the filament, wherein:

the filament comprises a substrate formed with a metal material and a visible light-absorbing film covering the substrate, wherein the visible light-absorbing film is transparent to lights of infrared region; and a surface of the substrate of the filament is polished into a mirror surface.

17. The light source device according to claim 16, wherein the surface of the substrate satisfies at least one of the following conditions for surface roughness: a center line average height (Ra) of 1 μm or smaller, a maximum height (Rmax) of 10 μm or smaller, and a ten-point average roughness (Rz) of 10 μm or smaller.

* * * * *